US005566408A

United States Patent [19]

McCarthy et al.

[11] Patent Number: 5,566,408

[45] Date of Patent: Oct. 22, 1996

[54] SUSPENDED COIL WAVE REDUCTION SYSTEM FOR A WATER MATTRESS

[76] Inventors: Kevin McCarthy, 9212 Adalee Ct., Columbia, Md. 21045; Robert Brooks, 14111 Adkins Rd., Laurel, Md. 20707

[21] Appl. No.: 572,060

[22] Filed: Dec. 14, 1995

[51] Int. Cl.[6] ..... A47C 27/08

[52] U.S. Cl. ..... 5/682; 5/920

[58] Field of Search ..... 5/451, 919, 920, 5/452, 450, 932

[56] References Cited

U.S. PATENT DOCUMENTS

| | | | |
|---|---|---|---|
| 4,109,333 | 8/1978 | Zmiarovich | 5/451 |
| 4,168,555 | 9/1979 | Bejamin | 5/452 |
| 4,204,289 | 5/1980 | Fogel | 5/451 |
| 4,296,510 | 10/1981 | Phillips | 5/450 |
| 4,310,936 | 1/1982 | Benjamin | 5/450 |
| 4,345,348 | 8/1982 | Hall | 5/450 |
| 4,551,873 | 11/1985 | Hall | 5/450 |
| 4,663,789 | 5/1987 | Smith | 5/450 |
| 4,715,076 | 12/1987 | Fogel et al. | 5/450 |
| 4,751,757 | 6/1988 | Moreno | 5/450 |
| 4,905,331 | 3/1990 | Hochschild, III | 5/450 |
| 4,961,237 | 10/1990 | Santo | 5/450 |
| 5,010,607 | 4/1991 | Sobie | 5/450 |
| 5,065,465 | 11/1991 | Nystad | 5/450 |
| 5,068,934 | 12/1991 | Johenning | 5/450 |
| 5,388,292 | 2/1995 | Stinson et al. | 5/450 |

*Primary Examiner*—Alexander Grosz

[57] ABSTRACT

A wave reduction system for a water mattress having a plurality of buoyant chambers sealed on a separation sheet used to divide the mattress interior between an upper and lower water containing chambers. The separation sheet is connected by a welded seam to a top and a bottom sheet of the mattress, and has cut-out portions at corners of the mattress to relieve stress on the welded seam. Passages are located in the separation sheet for communicating with each chamber.

4 Claims, 1 Drawing Sheet

SUSPENDED COIL WAVE REDUCTION SYSTEM FOR A WATER MATTRESS

BACKGROUND OF THE INVENTION

Currently there are several types of wave reduction systems used within water mattresses. For example, the patent to Smith U.S. Pat. No. 4,663,789 discloses a hydraulic baffle for a waterbed. The baffle shown in Smith floats freely in the water and has tubular structures extending upwardly therefrom. Unfortunately, the baffle taught by Smith fails to evenly distribute waves over a long period of time because the baffle moves too freely and after an extended use is pulled to one side of the bed's interior.

Another attempt to reduce wave motion is taught by Phillips in U.S. Pat. No. 4,296,510. Phillips teaches the use of an intermediate wall to define fluid tunnels located beneath the intermediate wall.

Zmiarovich U.S. Pat. No. 4,109,333 and Fogel U.S. Pat. No. 4,204,289 still further disclose water mattresses having fluid chambers. Fogel teaches the use of baffles having foam floatation members.

Another wave reduction system is comprised of various numbers of layers of polyester fiber. In cases where these layers of fiber are not secured by some means to the comers of the mattress, the fiber is free to move about within the mattress and can become unevenly distributed within the mattress through use. In cases where the fiber layers are attached by some means to the comers of the mattress, the entire force of the fiber's motion within the mattress is transferred to these attachment points, making them prone to tearing and leaking. In all cases, the fiber layers have the ability to retain water, causing mattresses using fiber layers for wave reduction difficult to drain.

Yet another wave reduction system is comprised of PVC sheeting welded in such a way as to form a plurality of rectangular chambers. The chambers are seamed to a sheet of PVC enclosing some sort of foam, such as PF or EPE, which causes the sheet to float within the water mattress with the plurality of rectangular chambers hanging downward from the floating sheet. In cases where the floating sheet is not attached by some means to the comers of the mattress, the floating sheet is free to move about within the mattress and can become unevenly distributed within the mattress through use. In cases where the floating sheet is attached by some means to the comers of the mattress, the entire force of the motion of the floating sheet within the mattress is transferred to these attachment points, making them prone to tearing and leaking. In all cases, the plurality of rectangular chambers attached to the floating sheet have the ability to retain water, making mattresses using this wave reduction system difficult to drain. Also, the rectangular chambers, which are pressed flat when the mattress is folded for shipment, rely only on gravitational forces to cause them to open out into their rectangular shape when the mattress is filled with water. It can thus take several days before the filled mattress's wave reduction system is functioning properly and, in some cases, the wave reduction system will never function properly because the chambers fail to open.

Another wave reduction system is comprised of PVC sheeting welded to form a plurality of closed cylindrical chambers, such cylindrical chambers being sealed to the bottom surface of the mattress. This wave reduction system introduces a large amount of seal area to the bottom of the mattress which is prone to cracking and leaking over time.

Also, a wave moving across such a system can be reduced only by those few cylindrical chambers with which it is in contact at a give time, rather than being acted against by the entire wave reduction system.

SUMMARY OF THE PRESENT INVENTION

The invention relates to flexible water containment structures, and the internal components of flexible water containment structures. More particularly, the invention is directed to water mattresses and internal components of water mattresses having the purpose of reducing the wave motion within water mattresses while the mattresses are in use.

An object of the present invention is to provide a wave reduction system for a water mattress.

Another object of the present invention is to provide a wave reduction system for a water mattress having a separation sheet for reducing wave motion.

A further object of the present invention is to provide a wave reduction system for a water mattress having a plurality of support chambers sealed on a separation sheet.

The object of the present invention is to provide a water mattress having a wave reduction system for providing a user with less waves during use and a long lasting mattress made with chambers and strong seams.

DETAILED DESCRIPTION OF THE PREFERRED EMBODIMENTS

Figure 1:
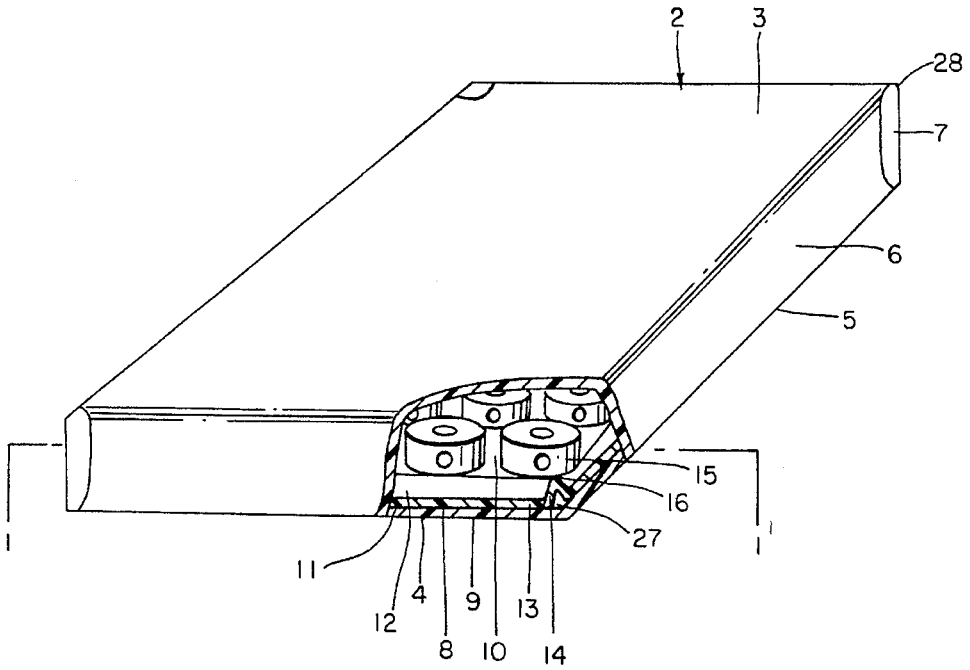
FIG. 1 is a cut-away perspective view of a water mattress having the present invention wave reduction system.

FIG. 1 illustrates a wave reduction system incorporated into a water mattress 2 having a top sheet 3 and a bottom sheet 4. The top sheet 3 covers a larger area than the bottom sheet 4 and they are seamed at 5 near lower part 6 of the top sheet. At each comer 28 of the mattress are support bolsters 7 which are seamed to the top sheet 3 and the bottom sheet 4. Each support bolster 7 is made of vinyl plastic having a thickness double of that of the top sheet 3 or the bottom sheet 4. The support bolsters 7 provide extra support at each comer 28 of the mattress to add a lifetime of support for the mattress.

As further illustrated in FIG. 1, the wave reduction system will now be described in detail. Welded to top surface 8 of bottom sheet 4 is a suspension sheet 9 that divides the mattress into an upper portion and a lower portion. The suspension sheet 9 has a top surface 10, a bottom surface 11, side surfaces 12 and bottom side edges 13. The suspension sheet bottom side edges 13 are incorporated into seam 14 which is formed by welding the top sheet 3, the bottom sheet 4 and the bottom side edges 13 together along the entire length and width of the mattress. The seam 14 permits even motion throughout the mattress and permits the motion of the wave reduction system to be distributed evenly throughout the mattress. The suspension sheet further permits a degree of freedom of motion to the entire wave reduction system as a whole, so that waves moving through the mattress are acted against by the entire wave reduction system as a whole, rather than by individual cylinders.

The suspension sheet 9 has cut-out portions 27 at each comer 28. Each cut-out portion 27 is U-shaped to permit fluid flow and relieve stress from the seam 14. The cut-out portion 27 also has a locking relationship with each support bolster 7 which supports each comer 28 of the mattress.

Another component of the wave reduction system are cylindrical chambers 15. Each chamber 15 has a bottom portion 16 sealed to top surface 10 of the suspension sheet 9. By sealing each chamber 15 to the suspension sheet 9 instead of the bottom sheet 4 of the water mattress extensive seams on the bottom sheet 4 are eliminated along with the chance of a seam ripping and breaking open the water mattress.

Figure 2:
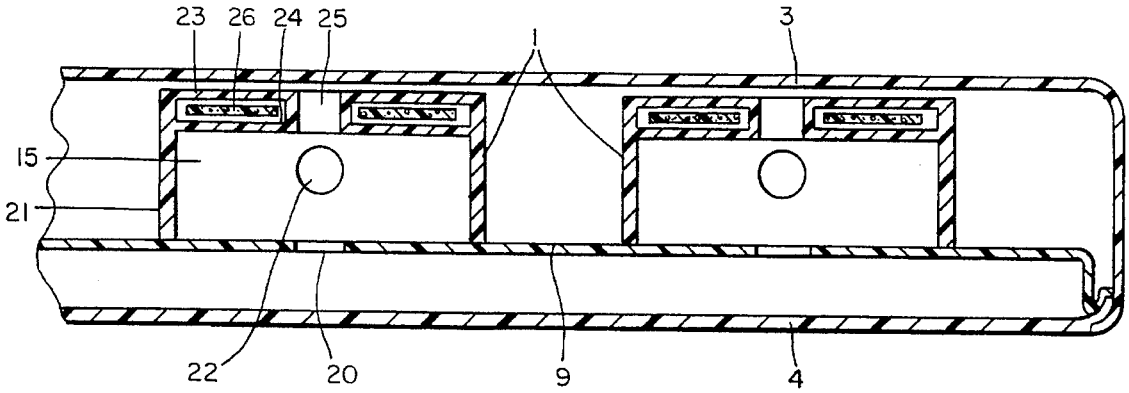
FIG. 2 illustrates the wave reduction system cross sectional view taken alone lines 1—1 of FIG. 1.

FIG. 2 illustrates the wave reduction system 1 in a cross sectional view taken alone lines 1—1 of FIG. 1. The suspension sheet 9 is provided with holes 20 beneath each closed cylinder to promote the draining of water from the mattress. Walls 21 of the chambers 15 are also provided with holes 22 to further promote the draining of water from the mattress. A circular piece of EPE foam 26 is enclosed and fixed into position by a circular PVC top cover sheet 23, and a circular PVC bottom cover sheet 24 together forming the top of each chamber 15. The circular EPE foam 26 at the top of each dosed cylinder causes the chambers 15 to open into their chamber shape immediately upon filling the mattress with water, ensuring the wave reduction system will function without delay, unlike prior art wave reduction systems. A hole 25 through the center of the circular PVC top cover sheet 23, the circular EPE foam 26, and the circular PVC bottom cover sheet 24 allows air to escape from the wave reduction system upon filling the mattress with water.

In order to fill the mattress with water, a spout in the bottom sheet receives a filling member and water is delivered to the mattress. The separation sheet is initially separated from the bottom sheet by the water. As the water continues to fill the mattress, the holes 20 permit entry of the water into each chamber and onto the top of the separation sheet. The circular EPE foam at the top of each closed cylinder causes the closed chambers 15 to open into their chamber shape immediately upon filling of water. The separation sheet also permits the water to more quickly enter each chamber due to the bottom of the mattress quickly and evenly filling with water.

Finally, a suspended coil wave reduction system is provided for a water mattress. Although a specific chamber is disclosed in this application, any columns or coil arrangement will work with this wave reduction system because of the novel suspension sheet.

We claim:

1. A water mattress having a plurality of corners and a wave reduction system comprising:

a top sheet;

a bottom sheet;

a suspension sheet having a top surface, said top sheet, said bottom sheet and said suspension sheet connected by a welded seam, said suspension sheet positioned between said top sheet and said bottom sheet, dividing the mattress into an upper portion and a lower portion, said suspension sheet having a plurality of holes permitting fluid communication between said upper and lower portions of the mattress, and cut-out portions at said corners, adapted to relieve stress on said welded seam, and a plurality of chambers sealed to said top surface of said suspension sheet, each chamber having a plurality of holes permitting fluid communication between said chambers and the upper and lower portions of the mattress, said chambers comprising buoyant means adapted to maintain said chambers in an expanded state upon the filling of the mattress with water.

2. The water mattress of claim 1, wherein the buoyant means comprises foam.

3. The water mattress of claim 1, further comprising bolster means at the corners of the mattress, for supporting said mattress.

4. The water mattress of claim 1, wherein the chambers are cylindrically shaped.

* * * * *